United States Patent [19]

Swain et al.

[11] 4,286,606

[45] Sep. 1, 1981

[54] TOBACCO FLAVORANTS

[75] Inventors: James W. Swain; Frank H. Crayton, both of Richmond, Va.

[73] Assignee: Philip Morris Incorporated, New York, N.Y.

[21] Appl. No.: 49,361

[22] Filed: Jun. 18, 1979

[51] Int. Cl.[3] ..... A24B 15/30; C08B 37/00; C08B 3/00

[52] U.S. Cl. ..... 131/276; 536/18; 536/58

[58] Field of Search ..... 131/17 R, 140 R, 140 C; 536/18, 56

[56] References Cited

U.S. PATENT DOCUMENTS

| | | | |
|---|---|---|---|
| 3,478,015 | 11/1969 | Onishi et al. | 260/211 |
| 3,729,009 | 4/1973 | Stones et al. | 131/17 R |
| 3,760,815 | 9/1973 | Deszyck | 131/140 C |
| 3,920,026 | 11/1975 | Warfield et al. | 131/17 R |

OTHER PUBLICATIONS

Chem. Abst. 79: 134498h
Chem. Abst. 89: 126336v.
Chem. Abst. 89: 126337w.
"Nitrogen Components of Leaf and Their Relationship to Smoke Quality and Aroma," by Leffingwell et al., *Recent Advances in Tob. Sciences,* vol. 2, pp. 1-31, 1976.
"Waxes and Lipids in Leaf and Their Relationship to Smoking Quality and Aroma," *Recent Advances in Tobacco Science,* vol. 2, 1976, pp. 80-111.
"Casing Material—Cocoa", Part I and II, *Tobacco International,* 181(5) and 181(6), pp. 40-52 and 18-43 respectively 3/9 and 3/23, 1970.
"Dehydrated Foods-Chemistry of Browning Reactions in Model Systems", *J. Ag. Food Chem.,* vol. 1, pp. 928-943, 1953 by Hodge.

*Primary Examiner*—V. Millin
*Attorney, Agent, or Firm*—Arthur I. Palmer, Jr.; Susan A. Hutcheson

[57] ABSTRACT

Reaction products useful for enhancing the organoleptic response of smoking materials are disclosed. The reaction of a reducing sugar, ammonia and carboxylic acid, whether saturated or unsaturated, and having from about 6 to 26 carbon atoms, results in flavorant products, which may be incorporated into smoking filler materials without additional processing, such as refining or isolating individual components of the mixture.

14 Claims, No Drawings

TOBACCO FLAVORANTS

BACKGROUND ART

One of the difficult and challenging problems for cigarette makers in recent years has been trying to produce acceptable low-delivery cigarettes that afford adequate flavor of the filtered and diluted smoke. The intrinsic flavor characteristics of tobacco smoke seem to depend to a large extent on the total particulate matter (TPM) contained therein. If most of the TPM is removed by filtration and/or dilution, the remaining smoke has an inadequate or even unacceptable taste. As a result, much of the commercial development effort has been concentrated in the area of blend selection; i.e., combining various types or grades of tobacco in a carefully selected blend effective to achieve somewhat lower delivery of TPM while retaining desired flavor characteristics of the smoke as far as possible and using additions of extrinsic flavorants of various kinds to supplement the natural flavor attributes of tobacco smoke.

The reaction of sugars and amino acids to produce desirable flavorants for smoking materials has generated increased interest. For example, U.S. Pat. No. 3,478,015 describes "browning reactions" in which an amino acid and a sugar having an active carbonyl are reacted in a lower alkyl polyhydric alcohol solvent in the absence of water at a temperature less than 90° C. for about 5 to 15 hours. The resultant reaction mixture is applied in an amount of about 1% by weight to tobacco.

Additional patents or publications that describe the formation of tobacco flavorants from browning-type reactions include, for example, U.S. Pat. No. 3,920,026 and Japanese Pat. Nos. 9239/71 and 3398/73. A review of browning reactions that may occur during tobacco curing, processing and smoking and their importance to tobacco flavoring, published in *Recent Advances in Tobacco Science,* Volume 2, pages 1–31, 1976, describes the numerous products of browning reactions of amino acids (or ammonia) and sugars present in tobacco and/or smoke.

The reaction products of the present invention differ from conventional browning reactions in that the substitution of carboxylic acids for amino acids results in novel reaction products. They may be described as potentiators that impart organoleptically the qualities that give the sensation of increased strength and fullness to the smoke of tobacco products including reconstituted tobacco, and low delivery smoking products.

Chemical Abstracts 89:126336v describes flavor formulations for tobacco wherein a mixture of ammonia or amino acids, $C_{1-10}$ fatty amines, $C_{2-8}$ fatty dicarbonyl compounds and/or sugars and nicotine is heated at about 130° for 5 hours to yield tobacco flavorants. Propylene glycol and/or glycerol are used as solvents. Chemical Abstracts 89:126337w describes similar formulations wherein amino acids, $C_{2-8}$ fatty dicarbonyl compounds and/or sugars with nicotine are heated to about 150° for 2 hours to produce tobacco flavorants. Water was used as the solvent medium.

U.S. Pat. No. 3,729,009 describes the addition to tobacco of carbamide and saturated fatty acids wherein the fatty acids have a carbon chain length of 16 to 18. The addition, particularly to tobacco blends high in stem material, apparently imparts a more pleasant taste and smell. "Pure" palmitic or stearic acid or mixtures thereof are added to tobacco blends at about 1.0 to 4% by weight of the blend.

U.S. Pat. No. 3,760,815 describes the addition of saturated or unsaturated fatty acids having 6 to 18 carbon atoms in combination with ammonium hydroxide to tobacco for the purpose of releasing pectins contained therein. Generally the fatty acid and ammonia are added to a tobacco slurry, which is maintained at a temperature of about 25° to 110° C. for about 0.5 to 24 hours. After the release of pectins is complete, the slurry is cast to form a sheet of tobacco material. Apparently the longer chain fatty acids, such as, for example, stearic, oleic, linoleic, and linolenic acid, or their ammonium salts, provide a subtle flavor characteristic to the smoke of tobacco treated in this manner.

D. L. Davis in *Recent Advances in Tobacco Science,* Volume 2, pages 80–111, 1976 describes the importance of waxes and lipids in tobacco leaf and their relationship to smoking quality and aroma. He states, "An important class of lipids, the fatty acids, do contribute to the smoke flavor and aroma. Many of the higher molecular weight fatty acids add a waxy smoothing taste to the smoke; however, linoleic and linolenic add harshness."

We have found, quite surprisingly, that flavor reactions using oleic, linoleic or linolenic acid, as well as other representative fatty acids, in combination with reducing sugars and ammonia provide increased body and strength to the smoke, and particularly the smoke of low delivery cigarettes, without the accompanying harshness as noted by Davis hereinabove.

DISCLOSURE OF INVENTION

The invention comprises a method of preparing reaction flavors for smoking products wherein a reducing sugar is reacted with a saturated or unsaturated fatty acid having generally between 6 and 26 carbon atoms in the presence of an excess of ammonium hydroxide. The reaction is maintained at a temperature in the range of about 70° to 150° C. for a period of time between about 0.5 and 3.0 hours depending on the reactants used. The invention also provides a filler of smoking material selected from tobacco, reconstituted tobacco, non-tobacco smoking substitutes and mixtures thereof, having incorporated therein from about 0.01 to about 5.0% by weight based on the dry weight of the filler of the reaction flavors prepared by the above-mentioned method. The reaction products are particularly useful as flavorants in the production of low-delivery smoking products having a delivery of 15 mg or less of total particulate matter.

In accordance with the present invention, suitable fatty acids include those acids having a carbon chain of 6 to about 26 and including both saturated and unsaturated acids. The present invention contemplates the use of substantially pure fatty acids and mixtures thereof. Representative acids include caproic, pelargonic, lauric, tetradecenoic, myristic, palmitic, stearic, oleic, linoleic, linolenic, ricinoleic acid, and the like. Alternatively, various vegetable oils containing glyceride esters of the above-mentioned fatty acids may be used. For example, corn oil, olive oil, coconut oil, safflower oil, peanut oil, and the like may be used. Block chocolate which is a solid mass obtained by grinding cocoa nibs (roasted embryo) without the removal of fat or other constituents may also be used. On a weight basis, about half of the block chocolate is composed of glyceride esters of oleic, lauric, palmitic, and stearic acids.

By definition, reducing sugars include glucose, fructose, mannose, galactose, maltose, rhamnose, or mixtures thereof, with fructose being preferred. Of course it will be recognized by those skilled in the art that condensed saccharides such as di-, tri-, tetra- and polysaccharides may be used in place of the above named monosaccharides. In this instance, an excess of ammonium hydroxide generally in a molar amount of about 3 to 1 based on the sugar, is required to assure complete hydrolysis of the sugar. Reaction times up to about three hours are generally sufficient when condensed saccharides are used.

BEST MODE FOR CARRYING OUT THE INVENTION

Carboxylic acids having a carbon chain between about 6 and 26 carbon atoms are reacted with a reducing sugar as defined hereinabove in the presence of ammonia or ammonium hydroxide. The reaction may be effected at atmospheric or superatmospheric pressures. The molar ratio of sugar to carboxylic acid may be in the range of about 1 to 0.01 to about 1 to 0.04 and is preferably about 1 to 0.024. Generally an excess of ammonium hydroxide is added to the reaction mixture to allow for some loss during the heating step. As a general rule, the molar ratio of ammonium hydroxide to sugar is in the range of about 1.2 to 1 to about 3 to 1 and preferably about 1.7 to 1. In some instances a small amount of water may be added to the reaction mixture; however, this is generally not necessary.

An additional aspect of the invention provides for reaction products prepared by reacting a reducing sugar or mixtures thereof with an oil containing glyceride esters of a variety of carboxylic acids. Suitable oils include corn oil, coconut oil, tung oil, tallow oil, olive oil, safflower oil, peanut oil, rape seed oil, and the like. Additionally, block chocolate containing desirable glycerides of fatty acids may be used to produce flavorants in a similar manner. The above-mentioned oils and block chocolate contain varying amounts of glyceride esters of a wide range of fatty acids, such as, for example, oleic, lauric, palmitic, stearic, linoleic, myristic, and the like. Other fatty acids suitable for use in the preparation of flavorants include ricinoleic, stearic, erucic, licanic, and the like. All of the above-mentioned acids may be used individually or in admixture with the preferred individual acids being oleic, linoleic, and linolenic.

The reaction is generally carried out at atmospheric pressure in a flask, preferably one provided with reflux, stirring and heating means. The flask and contents may be heated in a steam bath, an oil bath, or the like, and the time necessary to reach the optimum temperature of about 70° to about 150° C. is determined either by the size of the reaction vessel or the temperature of the heating system or both. The reaction is generally maintained in the desired temperature range for about 0.5 to 1.5 hours or less depending on the conditions employed. When a condensed saccharide is used, reaction times are generally extended to about 3 hours to obtain the desired reaction flavor. Alternatively, the reaction may be conducted at superatmospheric pressure in a convenient range, generally between about 100 and 150 atmospheres. In this instance, a pressurized reaction vessel is employed. Generally the reaction time will be shortened somewhat when superatmospheric conditions are utilized.

When large-scale reactions are conducted, it is generally desirable to add an acceptable emulsifier during the reaction to promote homogeneity of the reactants. The emulsifier should not adversely affect the reaction product flavorant characteristics. We have found an emulsifier, Complem X-50, purchased from American Cyanamid to be acceptable for our purposes.

The reaction product may be used immediately after cooling and, in most instances, is diluted with an appropriate solvent such as water, ethanol or mixtures thereof prior to applying to tobacco. The degree to which the reaction mixture is diluted is a matter of choice and may, to some extent, depend upon its ultimate use. Generally a 1:1 to about a 1:5 dilution with water or a water-ethanol mixture is sufficient and results in an aqueous product adaptable for use on any type of smoking material.

The term "smoking material" encompasses all types of tobacco, such as shredded filler, leaf, stem, stalk, homogenized leaf cured, reconstituted tobacco and blended mixtures thereof. In addition, smoking materials may encompass the various smoking substitutes formulated from non-tobacco materials. These materials may be utilized alone or blended in varying proportions with tobacco components. Representative formulations for non-tobacco smoking materials may be found in U.S. Pat. Nos. 3,529,602; 3,703,177; 3,796,222; 4,019,521; 4,079,742; and references cited therein.

The reaction flavors produced in accordance with the present invention may be applied to the smoking materials by direct spraying methods known in the art. They may also be applied by dispersing or diluting further in a suitable carrier, water for example, or may be directly mixed or otherwise combined with the smoking material. When an aqueous carrier is employed, the mixture is air-dried or otherwise treated to remove the carrier.

The reaction flavors may, if desired, be incorporated in cigarette paper or in filters. However, it will generally be more desirable to incorporate the flavors in the smoking material itself.

In some instances, the reaction flavor may be added to a concentrated tobacco extract containing water soluble tobacco constituents, humectants, and the like, and thereafter the extract containing the flavors is applied to a fibrous tobacco web as in making reconstituted tobacco. In this particular instance, the amount of reaction flavor added will generally be in the range of 0.1 to about 5.0% by weight of the finished tobacco sheet. When the reaction flavors are applied to a typical tobacco blend, the weight of flavors in the final product will generally represent from about 0.01% to about 5.0% by weight of the total blend. Similar weight amounts may be used in preparing smoking substitutes for use alone or in combination with tobacco blends.

The following examples are illustrative. It should be noted that all of the cigarettes prepared for subjective smoking analysis contained approximately 800 mg of tobacco filler material unless otherwise stated.

EXAMPLE 1

Approximately 180 grams of a 72% fructose syrup, (0.7 mole fructose) produced by Clinton Corn Processing Company was combined with 4.8 grams (0.017 mole) linoleic acid (Fisher Scientific) in a 1 liter reaction vessel, which was insulated and equipped with a condenser, thermometer, and mechanical stirrer. To the stirred mixture was added 1.0 mole of ammonia added as 60 grams of ammonium hydroxide (29.7% $NH_3$). The mixture was then heated at 80° C. for 0.5 hours.

After cooling, a solution of the reaction mixture was sprayed onto uncased reconstituted tobacco, and cigarettes were made using the treated tobacco. Each cigarette contained approximately 800 mg of filler to which was added 8 mg of the reaction mixture. On smoking, a panel of expert smokers found the treated reconstituted tobacco to have an improved flavor when compared to an untreated control.

In a similar study, a solution of the reaction mixture was applied as an overspray onto cased tobacco that was then used to make cigarettes designed to deliver between 2 and 3 mg TPM. On smoking, the panel of expert smokers found the treated cigarettes to be more flavorful than the untreated, cased control.

EXAMPLE 2

In a similar manner to Example 1, 180 grams of a 72% fructose syrup (0.7 moles), 4.8 grams (0.017 moles) of oleic acid (Eastman) and 60 grams of ammonium hydroxide (29.7% $NH_3$) were combined in a reaction vessel and heated at 80° C. for 0.5 hours.

A solution of the reaction mixture was sprayed on uncased reconstituted tobacco and experimental cigarettes containing 100% of the treated tobacco were fabricated. Similar control cigarettes containing untreated reconstituted tobacco were also fabricated, and both cigarettes were smoked by an expert panel of smokers. The subjective response of the smokers indicated that the control cigarette was milder, smoother, and less harsh than the experimental cigarette, which contained approximately 8 mg/cigarette of the reaction mixture.

In a similar manner, a tobacco blend for low delivery cigarettes was sprayed with an aliquot of the reaction mixture. After drying, cigarettes designed to deliver approximately 2 to 3 mg TPM were made using the cased and treated tobacco blend. Control cigarettes having the same cased but untreated tobacco were prepared and both cigarettes were smoked by a group of panelists. The experimental low delivery cigarette showed elevated flavor response at about 5 to 8 mg/cigarette of the reaction mixture.

EXAMPLE 3

A mixture of 360 grams of 72% fructose syrup (1.4 moles), 9.3 grams linoleic acid, 120 grams of ammonium hydroxide (29.7% $NH_3$) and 18.5 ml of water was reacted at 81° C. for 0.5 and 1 hour as in Example 1, and the resultant reaction mixtures were labeled A and B respectively. The reaction mixtures were diluted with 100 ml of a 70/30 mixture of water-ethanol. The dilute solutions were applied as an afterspray to typically cased commercial blends of tobacco at a level ranging from 0.3 to about 0.8% by weight of the blend. Cigarettes containing the treated blend were smoked by a small panel of expert smokers and compared to the same blend without the reaction mixture applied thereto. The treated, experimental cigarettes had increased body, flavor, and fullness when compared to the control cigarettes.

EXAMPLE 4

The reaction mixture of Example 3 was prepared in an identical manner with the exception that 18.6 grams of linoleic acid was used. The mixture was heated at 80° C. for 0.5 hour.

The mixture was diluted with 100 ml of a 70/30 mixture of water-ethanol and the diluted solution was applied to a blend of tobacco as in Example 3. Cigarettes designed to deliver 2 mg TPM were made using the treated tobacco. On smoking, increased flavor was noted.

An aliquot of the diluted reaction mixture was applied at the same level as in Example 3 by spraying on a blend of tobaccos and cigarettes designed to deliver 4 to 5 mg TPM were made. On smoking the overall flavor of the treated tobacco exceeded the flavor of the untreated control.

EXAMPLE 5

A mixture containing 360 grams of 72% fructose syrup, 114 grams of ammonium hydroxide, 19 mls of water, and 37.2 grams of Nestles block chocolate[1] was prepared. Half of the mixture was reacted at 81° C. for 0.5 hour and the other half for 1 hour. The resultant reaction mixtures were injected into cigarettes of 100% reconstituted tobacco at a level of 1% by weight of the tobacco. An identical amount of the reaction mixture was injected into a full flavored commercial cigarette. On smoking both treated cigarettes had additional impact and flavor when compared to their corresponding untreated controls. The reaction mixture that was heated for 60 minutes appeared to have the best overall flavor profile.

[1]Block chocolate is a solid mass obtained by grinding cocoa nibs (roasted embryo) without the removal of fat or other constituents. On a weight basis, about half of the block chocolate is composed of glyceride esters of oleic, lauric, palmitic, and stearic acids.

EXAMPLE 6

A mixture containing 360 grams of 72% fructose syrup, 114 grams of ammonium hydroxide, 18 ml water, and 10 grams of corn oil[2] (Best Foods) was heated in a reaction vessel as in Example 1, for 1 hour at 95° C.

[2]The approximate composition of the corn oil is as follows: glycerides of fatty acids including palmitic acid, 7 to 11%; stearic acid, 3 to 4%; oleic acid, 43 to 49%; and linoleic acid, 34 to 42%.

When the reaction mixture was applied to uncased, low delivery cigarettes at a level of about 5–8 mg/cigarette, the subjective response was similar to that elicited in Examples 1 and 2.

EXAMPLE 7

In a manner similar to Example 6, 360 grams of 72% fructose syrup, 114 grams of ammonium hydroxide, and 10 grams of olive oil[3] were combined and reacted at 140° C. for 1 hour. After cooling, the reaction product was injected at a level of 5–8 mg/cigarette into cigarettes designed to deliver 5 mg TPM. On smoking the treated cigarettes in comparison with untreated controls were found to have an increased amount of overall total response, particularly with respect to flavor notes. Cigarettes containing 100% reconstituted tobacco treated at a level of 5–8 mg/cigarette of the reaction product resulted in an increased flavor response on smoking.

[3]The approximate composition of olive oil is as follows: glycerides of fatty acids including oleic acid approximately 82%; palmitic acid, 5 to 15%; linoleic acid, 4 to 12%; and stearic acid 1 to 4%.

EXAMPLE 8

Following the procedure of Example 7, 360 grams 72% fructose syrup, 114 grams ammonium hydroxide, 10 grams coconut oil[4], and 18.5 grams water were combined and reacted at 100° C. for 1 hour. A commercial blend of cased tobaccos was treated with a solution of the reaction mixture at a level to insure approximately 5 to 7 mg of reaction mixture per cigarette. Cigarettes designed to deliver approximately 8 to 9 mg TPM were made and smoked by panelists who found the treated tobacco delivered a fuller, stronger or heavier smoke as compared to untreated tobacco of the identical blend.

[4]The approximate composition of coconut oil is as follows: glycerides of fatty acids including 5 to 10% oleic acid, 10 to 20% myristic acid, 4 to 10% palmitic acid, and 1 to 5% stearic acid.

EXAMPLE 9

Using the same procedure and formulation as shown in Example 8, except that 10 grams of safflower oil[5] was substituted for the coconut oil, a reaction mixture was prepared and applied to low delivery cigarettes at a level of about 5 to 8 mg/cigarette. The reaction mixture tended to amplify the total response of the low delivery cigarette on smoking.

[5]The approximate composition of safflower oil is as follows: glycerides of fatty acids including palmitic acid, 6.4%; stearic acid, 3.1%; oleic acid, 13.4%; and linoleic acid, 76 to 79%.

EXAMPLE 10

The procedure of Example 8 was repeated using the identical formulation with the exception that 10 grams of peanut oil[6] was used in place of the coconut oil. The resultant reaction mixture was applied to low delivery uncased cigarettes at a level of approximately 5 to 8 mg/cigarette. An increased flavor response was noted when the treated cigarettes were smoked and compared to untreated controls.

[6]The approximate composition of peanut oil is as follows: glycerides of fatty acids including oleic acid, 50 to 75% and linoleic acid, 13 to 26%.

EXAMPLE 11

A mixture containing 720 grams of 72% fructose syrup, 228 grams ammonium hydroxide, 30 grams of water, and 18.6 grams of ricinoleic acid (Eastman) was heated at 100° C. for 1 hour. After cooling, approximately 4 to 8 mg of the reaction mixture was injected into cased cigarettes containing about 27.5% reconstituted tobacco as part of the blend. The treated cigarettes had a smoother, more flavorful smoke.

EXAMPLE 12

In a similar manner to the preceding example, a mixture of 360 grams of 72% fructose syrup, 114 grams of ammonium hydroxide, and 10 grams of palmitic acid (Eastman) was reacted at 100° C. for 1 hour. The reaction mixture was cooled and 10 μl were injected into uncased cigarettes designed to deliver 8 mg TPM. The treated cigarettes had a fuller and heavier pipe-like flavor when compared to untreated controls.

EXAMPLE 13

In order to demonstrate similar subjective effects using a sugar other than fructose, the following ingredients were combined and reacted as in Example 12: 360 grams of reagent grade glucose (Fisher Scientific), 115 grams ammonium hydroxide, 10.8 grams linoleic acid, and 108 grams water. The cooled reaction mixture was injected at a level of 8 to 10 mg/cigarette into cigarettes designed to deliver 4 mg TPM. The treated cigarettes had increased flavor and strength when compared to controls. The overall subjective characteristic were similar to those found in cigarettes treated with the same formulation wherein fructose was used.

EXAMPLE 14

A mixture containing 518 grams of 56% maltose syrup (Staley Company), 60 grams of ammonium hydroxide, and 9.6 grams of linoleic acid was heated at 98° C. for 1 hour. Low delivery cigarettes treated with 5 mg of the reaction mixture had increased strength and impact on smoking. There appeared to be no preference for the maltose reaction product when compared to a similar formulation wherein fructose was used.

EXAMPLE 15

In a similar manner to Example 14, 558 grams of 45% maltose (Malt Diastase Company) was reacted with 60 grams of ammonium hydroxide and 5 grams linoleic acid. This reaction product was very similar subjectively to Example 14 when injected at 8 mg/cigarette. The effects of the reaction mixture on the experimental cigarette were described by a panel of smokers as more flavorful and improved overall total response.

EXAMPLE 16

A reaction mixture containing 180 grams of 72% fructose, 65 grams of ammonium hydroxide and 4.5 grams of hexanoic acid (Eastman) was heated at 98° C. for approximately 40 minutes. After cooling, a solution of the reaction product was sprayed onto a tobacco blend in an amount sufficient to give between 0.6 to 1.0% reaction product by weight of the tobacco. Cigarettes were made from the treated tobacco blend which contained about 28% reconstituted tobacco by weight of the blend. The treated cigarettes had a milder smoke when compared to untreated controls.

EXAMPLE 17

The identical formulation of Example 16 was used with the exception that 4.0 grams of nonanoic acid (Eastman) was used instead of hexanoic acid. The reaction mixture was heated at 90° C. for 35 minutes, cooled, and applied to low delivery cigarettes at a level sufficient to give approximately 1% of the reaction mixture by weight of the cigarette blend. On smoking, the treated cigarettes showed an increase in fullness and strength when compared to untreated controls.

EXAMPLE 18

The procedure and formulation of Example 16 was repeated with the exception that 4.5 grams of myristic acid replaced the hexanoic acid. To a tobacco blend containing about 28% reconstituted tobacco was added 1.0% of the reaction product by weight of the blend. On smoking, the treated tobacco was found to have increased strength and flavor when compared to untreated controls.

We claim:

1. A method of preparing a reaction flavor which comprises combining reactants including a reducing sugar, in the presence of ammonium hydroxide with a saturated or unsaturated carboxylic acid or mixtures thereof, said acid having between about 6 and 26 carbon atoms, and heating the reactants in a temperature range between about 70° and 150° C. for a period of time of from about 0.5 hour to about 3 hours.

2. The method of claim 1 wherein the carboxylic acid reactant is selected from the group consisting of caproic, pelargonic, lauric, tetradecenoic, myristic, palmitic, stearic, oleic, linoleic, linolenic, ricinoleic acid, and mixtures thereof.

3. The method of claim 1 wherein the carboxylic acid is selected from the group consisting of corn oil, rape seed oil, tung oil, tallow oil, peanut oil, coconut oil, safflower oil, olive oil, and block chocolate.

4. The method of claim 2 wherein the carboxylic acid is selected from oleic, linoleic, linolenic, and mixtures thereof.

5. The method of claim 1 wherein the reducing sugar is selected from the group consisting of glucose, fructose, mannose, galactose, maltose, rhamnose, and mixtures thereof.

6. The method of claim 1 wherein the molar ratio of reducing sugar to carboxylic acid is from about 1 to 0.01 to about 1 to 0.04.

7. The method of claim 1 wherein the molar ratio of ammonium hydroxide to reducing sugar is from about 1.2 to 1 to about 3 to 1.

8. The method of claim 1 wherein the reactants are heated at atmospheric or superatmospheric pressure.

9. A reaction flavor product prepared by the process of claim 1.

10. A smoking composition comprising a filler material selected from tobacco, reconstituted tobacco, non-tobacco smoking substitutes and mixtures thereof, and the reaction flavor product of claim 9.

11. The smoking composition of claim 10 comprising blended tobaccos having incorporated therein between about 0.01% to about 5.0% by weight of the filler of a reaction flavor.

12. The smoking composition of claim 10 comprising reconstituted tobacco having incorporated therein between about 0.1% and 5.0% by weight of the filler of a reaction flavor.

13. The smoking composition of claim 10 comprising a non-tobacco smoking substitute having incorporated therein between about 0.01% and 5% by weight of the filler of a reaction flavor.

14. A low delivery smoking product comprising a filler of material selected from tobacco, reconstituted tobacco, and mixtures thereof, and the reaction flavor product of claim 9.

* * * * *